US008253311B2

(12) United States Patent
Ban et al.

(10) Patent No.: US 8,253,311 B2
(45) Date of Patent: Aug. 28, 2012

(54) SPARK PLUG

(75) Inventors: Kenji Ban, Gifu (JP); Akira Suzuki, Aichi (JP); Jiro Kyuno, Aichi (JP)

(73) Assignee: NGK Spark Plug Co., Ltd, Aichi (JP)

( * ) Notice: Subject to any disclaimer, the term of this patent is extended or adjusted under 35 U.S.C. 154(b) by 0 days.

(21) Appl. No.: 12/737,331

(22) PCT Filed: Aug. 31, 2009

(86) PCT No.: PCT/JP2009/065167

§ 371 (c)(1),
(2), (4) Date: Dec. 30, 2010

(87) PCT Pub. No.: WO2010/026940

PCT Pub. Date: Mar. 11, 2010

(65) Prior Publication Data

US 2011/0095672 A1 Apr. 28, 2011

(30) Foreign Application Priority Data

Sep. 2, 2008 (JP) ..... 2008-224877

(51) Int. Cl.
*H01T 13/20* (2006.01)

(52) U.S. Cl. ..... 313/141; 313/143

(58) Field of Classification Search ..... 313/118–145; 123/143 R, 146.5 R, 169 R, 169 EL, 169 P, 123/260, 280
See application file for complete search history.

(56) References Cited

U.S. PATENT DOCUMENTS

| | | | | |
|---|---|---|---|---|
| 6,121,719 | A * | 9/2000 | Matsutani et al. | 313/141 |
| 6,750,597 | B1 * | 6/2004 | Sakura | 313/141 |
| 2007/0216275 | A1 | 9/2007 | Torii et al. | 313/141 |
| 2008/0122334 | A1 * | 5/2008 | Kishimoto et al. | 313/141 |

FOREIGN PATENT DOCUMENTS

| | | |
|---|---|---|
| JP | 2-295085 | 12/1990 |
| JP | 11-154584 | 6/1999 |
| JP | 11-185928 | 7/1999 |
| JP | 2007-287667 | 11/2004 |

OTHER PUBLICATIONS

International Search Report for International Application No. PCT/JP2009/065167, Sep. 29, 2009.

* cited by examiner

*Primary Examiner* — Mariceli Santiago
*Assistant Examiner* — Donald Raleigh
(74) *Attorney, Agent, or Firm* — Kusner & Jaffe

(57) ABSTRACT

A spark plug capable of preventing breakage of a ground electrode. The spark plug is comprised of a ground electrode having a base end portion fixed to a metal shell, a bend portion integrally formed with the base end portion and being bent and a front end portion integrally formed with the bend portion and forming a spark discharge gap "g" with a center electrode. The ground electrode is comprised of a core extending from the base end portion towards the front end portion through the bend portion; and an outer layer disposed outside the core and extending from the base end portion up to the front end portion through the bend portion. The core is made of Hastelloy C serving as a first metal, and the outer layer is made of Inconel 601 serving as a second metal. Hardness of Hastelloy C is higher than that of Inconel 601.

6 Claims, 8 Drawing Sheets

SPARK PLUG

FIELD OF THE INVENTION

The present invention relates to a spark plug.

BACKGROUND OF THE INVENTION

A conventional spark plug is disclosed in Japanese Patent Application Laid-Open (kokai) No. H11-185928 (Patent Document 1). The spark plug is comprised of a ground electrode having a base end portion fixed to a metal shell, a bend portion integrally formed with the base end portion and being bent, and a front end portion integrally formed with the bend portion and forming a spark discharge gap with a center electrode.

The ground electrode is comprised of: a core extending from the base end portion towards the front end portion through the bend portion; a heat transfer portion disposed outside of the core and extending from the base end portion towards the front end portion through the bend portion; and an outer layer disposed outside of the heat transfer portion and extending from the base end portion up to the front end portion through the bend portion.

The core is made of pure nickel, and the heat transfer portion is made of copper, and the outer layer is made of a nickel base alloy. The pure nickel constituting the core has Vickers hardness Hv of 96, which is higher than that of the copper of 46. The copper constituting the heat transfer portion has thermal conductivity of 0.94 cal/cm·sec·° C., which is greater than that of the nickel base alloy. Further, the copper constituting the heat transfer portion has a coefficient of thermal expansion of $17.0\times10^{-6}$/° C., which is greater than that of the nickel base alloy of $11.5\times10^{-6}$/° C. and that of the pure nickel of $13.3\times10^{-6}$/° C. The nickel base alloy constituting the outer layer has better heat resistance and corrosion resistance than those of copper and pure nickel.

The conventional spark plug having such composition is mounted on an engine and repeatedly discharges between the center electrode and the ground electrode under high temperature conditions.

In this spark plug, since the copper constituting the heat transfer portion has excellent thermal conductivity, the heat in the front end portion is effectively conducted to the base end portion through the heat transfer portion, whereby the heat can be properly transferred from the metal shell to the engine. That is, this spark plug can prevent the heat rise in the front end portion and exhibit outstanding durability as the heat transfer portion has excellent thermal conduction.

However, since the spark plug has the heat transfer portion in which the copper constituting the heat transfer portion has large coefficient of thermal expansion, the ground electrode tends to be lifted up under high temperature conditions. When the ground electrode is lifted up, the spark discharge gap formed between the ground electrode and the center electrode varies. This variation causes adverse effect on the ground electrode. Thus, the spark plug is capable of preventing this lift-up phenomenon of the ground electrode by adjusting the thicknesses of the heat transfer portion and the outer layer. Further, since the hardness of the pure nickel constituting the core is higher than that of the copper constituting the heat transfer portion contributes to the prevention of the lift-up phenomenon of the ground electrode.

SUMMARY OF THE INVENTION

Problem(s) to be Solved by the Invention

In a spark plug, a ground electrode is likely to break when excessive force is applied on the ground electrode.

Although the conventional spark plug adopts the core having the higher Vickers hardness than that of the heat transfer portion, the hardness of the core is lower than that of the outer layer. There is still a possibility that the ground electrode may break.

In order to overcome this problem, the ground electrode can be made large in size or made into a shape which is not easily broken. However, in the recent years, a spark plug has been made slimmer, and in connection with it, the ground electrode is also miniaturized. Therefore, those measures mentioned-above are difficult to be materialized.

The present invention has been accomplished in view of the above-mentioned problems, and an object of the present invention is to provide a spark plug capable of assuredly preventing a breakage of the ground electrode.

Means for Solving the Problem

A spark plug according to the present invention is comprised of a ground electrode having a base end portion fixed to a metal shell, a bend portion integrally formed with the base end portion and being bent, and a front end portion integrally formed with the bend portion and forming a spark discharge gap with a center electrode, wherein the ground electrode is comprised of: a core extending from the base end portion towards the front end portion through the bend portion; and an outer layer disposed outside of the core and extending from the base end portion up to the front end portion through the bend portion, wherein the core is made of a first metal, and the outer layer is made of a second metal, and wherein hardness of the first metal is higher than that of the second metal.

In the spark plug according to the present invention, the first metal that constitutes the core has hardness higher than that of the second metal that constitutes the outer layer. Thus, even when substantial force is applied to the outer layer and which might cause damages to the ground electrode, the core has a sufficient amount of resistance against such force.

Therefore, the spark plug according to the present invention can assuredly prevent a breakage of the ground electrode. In this regard, a conventional reinforcement of the ground electrode is only defined based on the comparison between hardness of the core and that of the heat transfer portion. Since the hardness of the first metal that constitutes the core is higher than that of the second metal that constitutes the outer layer, the spark plug according to the present invention exhibits remarkable reinforcement effect as compared to that of the conventional art. Thus, the breakage of the ground electrode can be assuredly prevented.

The second metal serving as the outer layer is generally selected from nickel base alloys, such as a Ni—Mn—Si alloy including a Ni—Mn—Si—Cr alloy and a Ni—Mn—Si—Cr—Al alloy, Inconel (Registered trademark) 600, and Inconel 601. Vickers hardness Hv of the second metal falls within the range from about 100 to 170. In addition, the outer layer according to the present invention excludes a thin film formed by a surface treatment, such as plating.

Further, the first metal serving as the core is selected from the metals having Vickers hardness Hv of about 170 to 210 and having higher hardness than that of the outer layer, such as Hastelloy A (Registered trademark), Hastelloy B and Hastelloy C.

The ground electrode is comprised of a heat transfer portion formed in the outer layer and extending from the base end portion towards the front end portion through the bend portion. The heat transfer portion is preferably made of a third metal having better thermal conductivity than those of the first metal and the second metal. In this case, since the heat in the front end portion of the ground electrode can be effectively transferred to the base end portion, excellent thermal conduction and outstanding durability is achievable.

A material of the third metal serving as the heat transfer portion can be selected from pure copper, a copper alloy and silver or the like.

Thus, the present invention may be carried out for both a spark plug having a ground electrode without the heat transfer portion and a spark plug having a ground electrode that includes the heat transfer portion. In the spark plug having the ground electrode that includes the heat transfer portion, the core may be disposed in the heat transfer portion, or the heat transfer portion may be disposed in the core. Further, the core may partially stick out from the heat transfer portion, or the heat transfer portion may partially stick out from the core. Alternatively, the core and the heat transfer portion may be formed independently.

In the spark plug according to the present invention, the heat transfer portion may be disposed outside of the core. Thus, since the heat transfer portion having excellent thermal conductivity comes in contact with the outer layer, the thermal conduction of the ground electrode becomes high even though the core has low thermal conductivity.

Moreover, in the spark plug according to the present invention, the core may be disposed outside of the heat transfer portion. As compared with the spark plug having the heat transfer portion disposed outside of the core, the breakage of the ground electrode can be assuredly prevented when the core, whose hardness is higher than that of the outer, layer comes in contact with the outer layer.

In the spark plug according to the present invention, the core is preferably deflected towards the center electrode at least in the middle of the bend portion as viewed in a cross-section perpendicular to the extending direction of the ground electrode. In the cross-sectional face of the ground electrode, at least in the middle of the bend portion, the cross-sectional area of the outer layer or those of the outer layer and the heat transfer portion on the side opposite to the center electrode is larger than the cross-sectional area of the outer layer or those of the outer layer and the heat transfer portion on the center electrode side. Thus, as compared to a spark plug having the ground electrode in which the center of the outer layer or that of the outer layer and the heat transfer portion is positioned at the same location as the center of the core, the outer layer, or the outer layer and the heat transfer portion, and the core function as a bimetal due to the difference in thermal expansion therebetween. Thus, the lift up tendency of the ground electrode under high temperature conditions is likely to be weakened.

The second metal preferably has better anti-oxidation properties than that of the first metal in a high-temperature region of 1000 degrees C. or more. Moreover, the second metal preferably has better anti-spark erosion properties than that of the first metal. For example, the outstanding durability is achievable when the second metal is made of Inconel 601 and the first metal is made of Hastelloy C.

DETAILED DESCRIPTION OF PREFERRED EMBODIMENTS

Hereafter, embodiments 1 to 6 which carry out the present invention will be described with reference to the drawings.

First Embodiment

Figure 1:
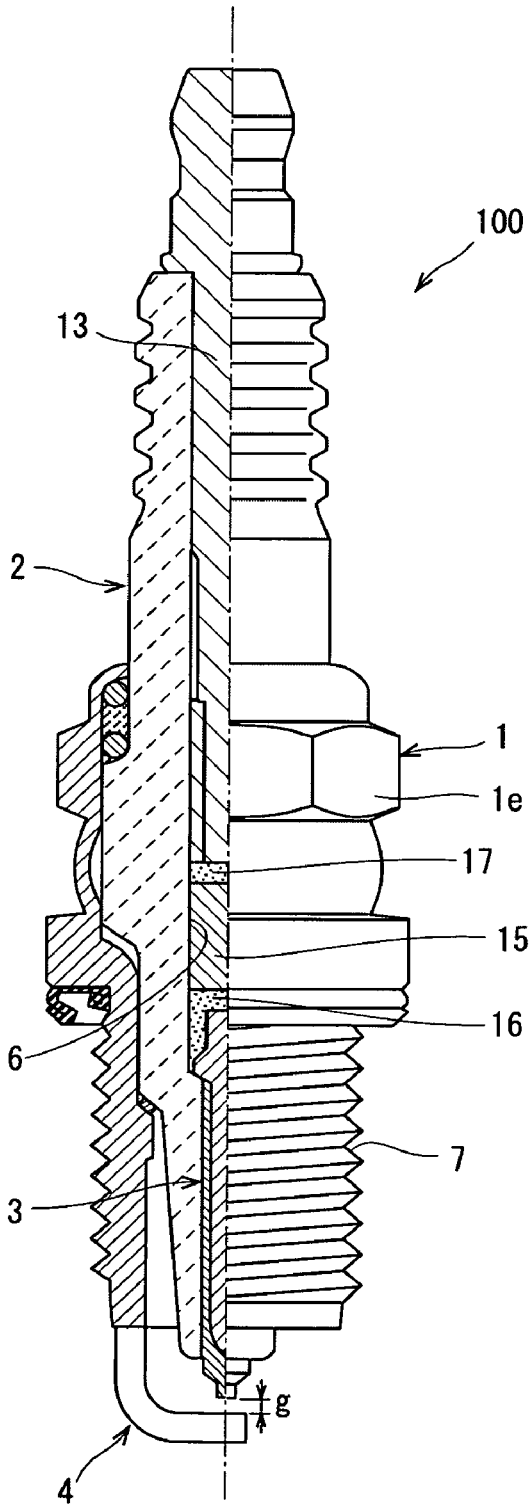
FIG. 1 is a front view (partial sectional view) of a spark plug according to a first embodiment.
Figure 2:
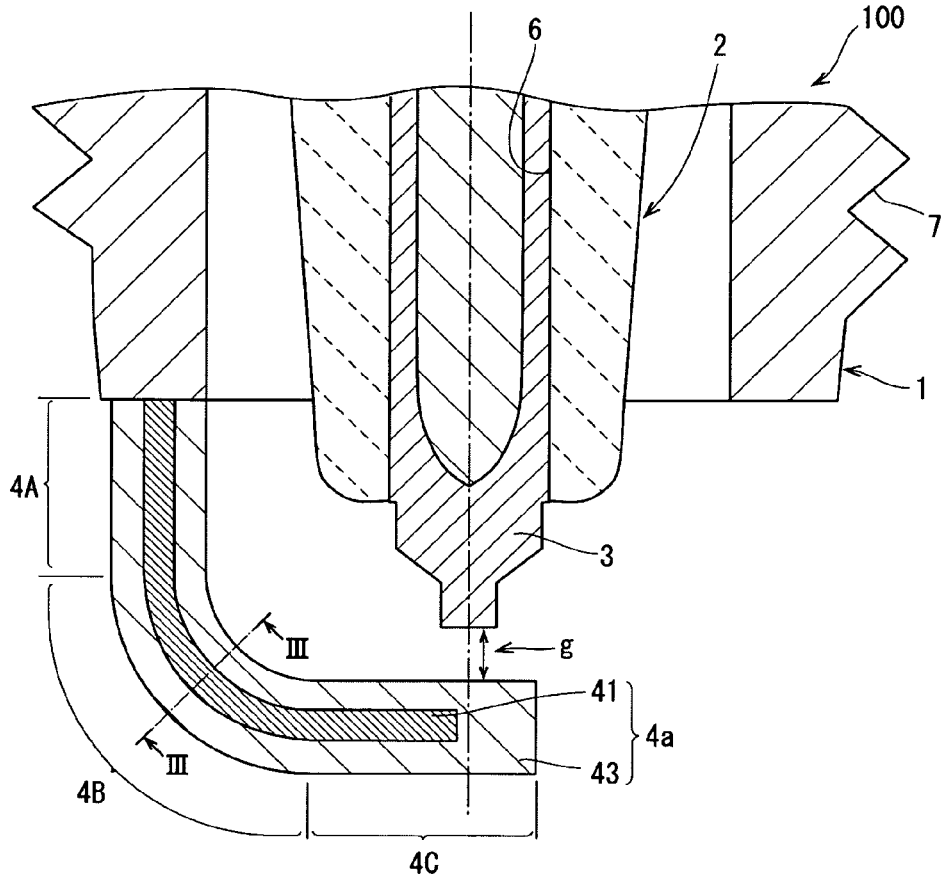
FIG. 2 is an enlarged sectional view of the main portion of the spark plug according to the first embodiment.

As shown in FIGS. 1 and 2, a spark plug 100 according to a first embodiment 1 is provided with a metal shell 1, an insulator 2, a center electrode 3 and a ground electrode 4. In addition, in FIGS. 1 and 2, a front end side represents the lower side in the drawing and a rear end side represents the upper side in the drawing.

The metal shell 1 assumes a cylindrical shape and made of a metal, such as a low-carbon steel. The metal shell 1 constitutes a housing of the spark plug 100 and has a threaded portion 7 and a tool engagement portion 1*e* on the outer circumferential face of the metal shell 1. The threaded portion 7 is used for mounting the metal shell 1 on an engine (not illustrated). The tool engagement portion 1*e* assumes a hexagonal shape in a cross-section view so as to engage with a tool, such as a spanner or a wrench, when mounting the metal shell 1.

An insulator 2 is made of insulating material containing mainly alumina or the like. The insulator 2 is inserted in the metal shell 1 so that a front end thereof projects from the metal shell 1. In the insulator 2, a penetration hole 6 is formed in an axial direction and used for accommodating the center electrode 3 and a terminal electrode 13 therein. The center electrode 3 is inserted in and fixed to the front end side of the penetration hole 6, and the terminal electrode 13 is inserted in and fixed to the rear end side of the penetration hole 6. Further, in the penetration hole 6, a resistor 15 is disposed between the terminal electrode 13 and the center electrode 3. Both ends of the resistor 15 are electrically connected to the center electrode 3 and the terminal electrode 13, respectively, through conductive glass seal layers 16 and 17. In addition, the resistor 15 is formed in such a manner that glass powder and electrically conductive material (and ceramic powder except for glass powder if necessary) are mixed and sintered by hot press or the like to thereby produce a resistor composition.

The center electrode 3 is a columnar body made of a nickel base alloy or the like. The front end of the center electrode 3 assumes a generally cone shape and projects from the front end of the penetration hole 6.

As shown in FIG. 2, a ground electrode 4*a* is comprised of: a base end portion 4A fixed by welding or the like to a front-end-side opening edge of the metal shell 1; a bend portion 4B integrally formed with the base end portion 4A and bent at a generally right angle in a circular arc form; and a front end portion 4C integrally formed with the bend portion 4B and facing the center electrode 3. A spark discharge gap "g" is formed between the front end portion 4C of the ground electrode 4*a* and the center electrode 3. In the spark plug 100, the ground electrode 4*a* is constituted by a side of 1.1 mm and another side of 2.2 mm. That is, a cross-sectional area "S" of the ground electrode 4*a* is 2.42 $mm^2$. A cross-sectional area S of the ground electrode 4*a* will be defined in a test described later.

The ground electrode 4*a* assumes a generally rectangular-rod shape in the cross-sectional view and has a two-layer structure. The ground electrode 4*a* is comprised of: a core 41 extending from the base end portion 4A towards the front end portion 4C through the bend portion 4B; and an outer layer 43 extending from the base end portion 4A up to the front end portion 4C through the bend portion 4B. The outer layer 43 extends up to the end of the front end portion 4C. On the other hand, the core 41 extends towards proximity of the axis of center electrode 3 in the front end portion 4C. The position of the front end of the core 41 in the front end portion 4C (either the front end side or the rear end side with respect to the axis of the center electrode 3) may be adjusted according to required properties, such as thermal conduction.

The core 41 is made of Hastelloy C that is a high durability nickel base alloy and serves as a first metal. Vickers hardness Hv of Hastelloy C is 210 and coefficient of thermal expansion thereof is $11.3\times10^{-6}$/° C.

The outer layer 43 is made of Inconel 601 that is a nickel base alloy and serves as a second metal. Vickers hardness Hv of Inconel 601 is 170 and coefficient of thermal expansion thereof is $11.5\times10^{-6}$/° C. Inconel 601 has excellent anti-oxidation and anti-spark erosion properties as compared to those of Hastelloy C in a high-temperature region of 1000 degrees C. or more.

Figure 3:
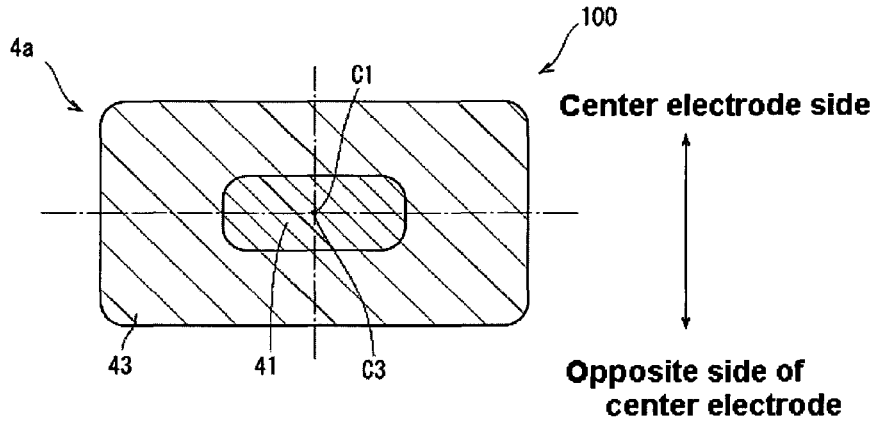
FIG. 3 is a sectional view of the spark plug according to the first embodiment taken along lines III-III of FIG. 2.

When the middle of the bend portion 4B of the ground electrode 4*a* is viewed in the cross-section (taken along lines III-III of FIG. 2) perpendicular to the extending direction of the ground electrode 4*a*, the core 41 is disposed in the center of the outer layer 43, as shown in FIG. 3. In other words, a center (equivalent to the center of gravity) C1 of the core 41 is positioned the same as a center C3 of the outer layer 43. As shown in FIG. 2, a relative positional relationship between the core 41 and the outer layer 43 in the entire area throughout the extending direction of the core 41 is the same as the relative positional relationship shown in FIG. 3. That is, the core 41 is disposed in the center of the outer layer 43 in the entire bend portion 4B. In addition, the front end of the core 41 may assume a taper shape toward the front end portion 4C of the ground electrode 4*a*.

The spark plug 100 according to the first embodiment is mounted on an engine (not illustrated) and repeatedly discharges between the center electrode 3 and the ground electrode 4*a* under high temperature conditions. In the spark plug 100 according to the first embodiment, Hastelloy A constituting the core 41 has higher hardness than Inconel 600 constituting the outer layer 43. Thus, even when substantial force is applied to the outer layer 43 and which might cause damages to the ground electrode 4*a*, the core 41 has a sufficient amount of resistance against such force.

Therefore, the spark plug 100 according to the first embodiment can assuredly prevent the breakage of the ground electrode 4*a*.

Further, similar to the spark plug 100 of the first embodiment, when the core 41 is formed in the outer layer 43, the ratio of the cross-sectional area of the core 41 to that of the ground electrode 4*a* falls within a range from 40% to 50%, whereby the thermal conduction of the ground electrode 4*a* can be improved.

Second Embodiment

Figure 4:
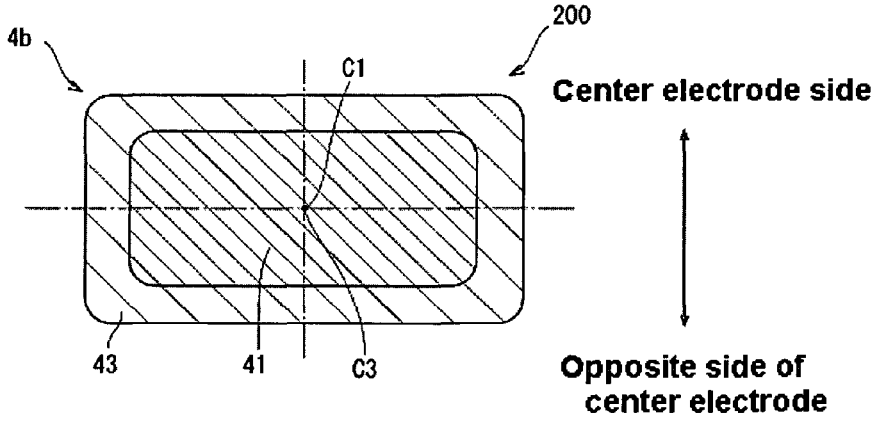
FIG. 4 is a sectional view (similar to FIG. 3) of the spark plug according to a second embodiment.

As shown in FIG. 4, a spark plug 200 according to a second embodiment has a ground electrode 4*b* having a thicker core 41 compared to that of the spark plug 100 according to the first embodiment. Other compositions of the second embodiment are the same as that of the first embodiment.

Since the core 41 is made thick, the spark plug 200 exhibits a remarkable suppressing effect of the breakage of the ground electrode 4*b* compared to that of the spark plug 100. A test below explains how thick the core 41 should be.

Third Embodiment

Figure 5:
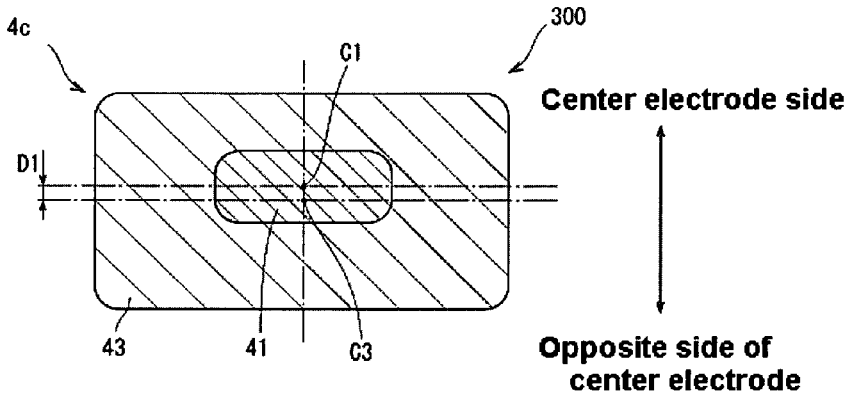
FIG. 5 is a sectional view (similar to FIG. 3) of the spark plug according to a third embodiment.

As shown in FIG. 5, in a spark plug 300 according to a third embodiment, the core 41 of a ground electrode 4*c* is deflected towards the center electrode 3 with respect to outer layer 43. In other words, the center C1 of the core 41 is deflected towards the center electrode 3 with respect to the center C3 of the outer layer 43 by a distance D1. In the entire area of the bend portion 4B, the core 41 is deflected towards the center electrode 3. That is, in the cross sectional view of the ground electrode 4*c*, the cross-sectional area of the outer layer 43 on the side opposite to the center electrode 3 is larger than that of the outer layer 43 on the center electrode 3 side. Other composition of the third embodiment is the same as that of the first embodiment.

Also in the spark plug 300, the breakage of the ground electrode 4*c* can be prevented by the core 41. Moreover, as compared to the spark plug 100 of the first embodiment in which the center C3 of the outer layer 43 coincides with the center C1 of the core 41, the outer layer 43 and the core 41 function as a bimetal due to difference in thermal expansion therebetween. Therefore, in the spark plug 300, a lift-up tendency of the ground electrode 4*c* under high temperature conditions is likely to be weakened.

Fourth Embodiment

Figure 6:
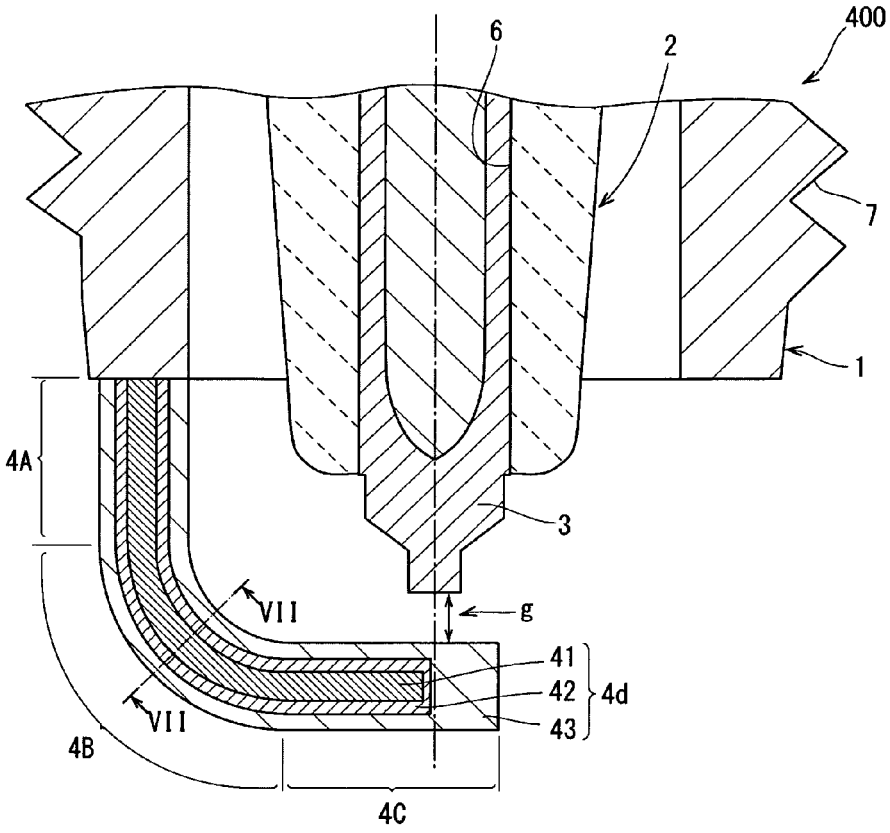
FIG. 6 is an enlarged sectional view of the main portion of the spark plug according to a fourth embodiment.

As shown in FIG. 6, a spark plug 400 according to a fourth embodiment has a ground electrode 4*d*. The ground electrode 4*d* has a three-layer structure and assumes a generally rectangular rod-shape. The ground electrode 4*d* includes: the core 41 extending from the base end portion 4A toward the front end portion 4C through the bend portion 4B; a heat transfer portion 42 disposed outside of the core 41 and extending from the base end portion 4A toward the front end portion 4C through the bend portion 4B; and the outer layer 43 disposed outside of the heat transfer portion 42 and extending from the base end portion 4A up to the front end portion 4C through the bend portion 4B. That is, the ground electrode 4*d* has the heat transfer portion 42 in the outer layer 43. The heat transfer portion 42 in the outer layer 43 is positioned outside of the core 41 so as to surround the entire core 41. The length of each front end of the core 41 and the heat transfer portion 42 in the front end portion 4C (i.e., the base end side or the front end side with respect to the axis of the center electrode 3) can be adjusted according to a required properties, such as thermal conduction.

The heat transfer portion 42 is made of copper serving as a third metal. Copper has a thermal conductivity of 0.94 cal/cm·second·° C., which is far better than those of Hastelloy C and Inconel 601. Moreover, copper has Vickers hardness Hy of 46, which is the lowest value in the metals constituting the ground electrode 4*d*. Furthermore, copper has coefficient of thermal expansion of 17.0×10-6/° C., which is the largest value in the metals constituting the ground electrode 4*d*.

Figure 7:
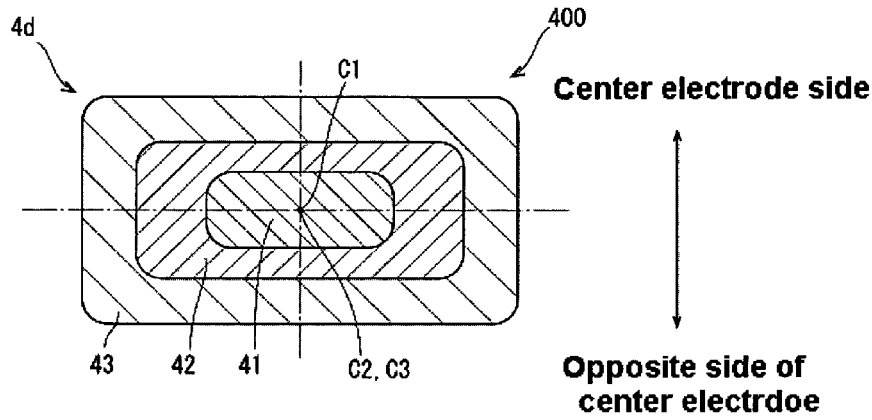
FIG. 7 is a sectional view of the spark plug according to the fourth embodiment taken along lines VII-VII of FIG. 6.

When the middle of the bend portion 4B is viewed in a cross-section (taken along lines VII-VII of FIG. 6) perpendicular to the extending direction of the ground electrode 4*d*, the core 41 and the heat transfer portion 42 are disposed in the center of the outer layer 43, as shown in FIG. 7. In other words, the center (equivalent to the center of gravity) C1 of the core 41 and a center C2 of the heat transfer portion 42 are positioned in the same location as the center C3 of the outer layer 43. A relative positional relationship among the core 41, the heat transfer portion 42 and the outer layer 43 shown in FIG. 7 is the same throughout the extending direction of the core 41 and the heat transfer portion 42. That is, the core 41 and the heat transfer portion 42 are disposed in the center of the outer layer 43 in the entire bend portion 4B. Other composition is the same as that of the first embodiment, the same reference numerals are indicated to the same composition and detailed explanation of the composition will be omitted.

In the spark plug 400, since the heat is effectively transferred from the front end portion 4C of the ground electrode 4*d* to the base end portion 4A through the heat transfer portion 42, excellent thermal conductivity is achievable. In this case, since the heat transfer portion 42 having excellent thermal conductivity is in contact with the outer layer 43, the ground electrode 4*d* can have excellent thermal conduction even though the core 41 has low thermal conductivity. Thus, the front end portion 4C is prevented from being at high temperature, whereby the outstanding durability of the ground electrode 4*d* is achievable. Other effects are the same as that of the first embodiment.

Further, similar to the spark plug 400 of the fourth embodiment, when the core 41 and the heat transfer portion 42 are formed in the outer layer 41, the ratio of the cross-sectional area of the core 41 to that of the ground electrode 4*d* falls within a range from 10% to 15%, whereby the thermal conduction of the ground electrode 4*d* can be improved.

Fifth Embodiment

Figure 8:
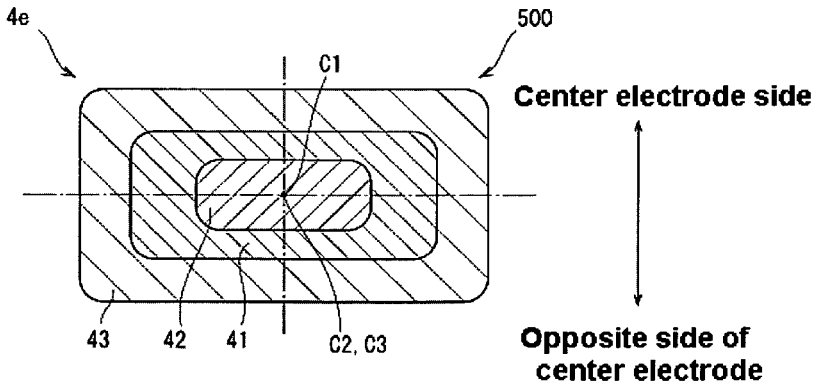
FIG. 8 is a sectional view (similar to FIG. 7) of the spark plug according to a fifth embodiment.

As shown in FIG. 8, in a spark plug 500 of a fifth embodiment, in the outer layer 43 of a ground electrode 4*e*, the core 41 is disposed outside of the heat transfer portion 42 so as to surround the entire heat transfer portion 42. Other compositions are the same as that of the fourth embodiment. Further, similar to the fourth embodiment, since the spark plug 500 has the heat transfer portion 42, excellent thermal conduction is achievable. Furthermore, the core 41 having a higher hardness than that of the outer layer 43 is in contact with the outer layer 43, a suppression of the breakage of the ground electrode 4*e* can be improved, compared to the spark plug 400 of the fourth embodiment.

Sixth Embodiment

Figure 9:
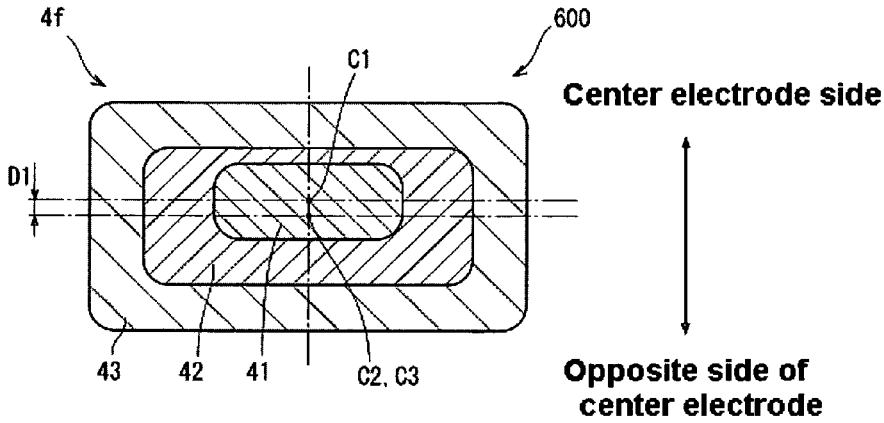
FIG. 9 is a sectional view (similar to FIG. 7) of the spark plug according to a sixth embodiment.

As shown in FIG. 9, in a spark plug 600 according to a sixth embodiment, the core 41 of a ground electrode 4*f* is deflected towards the center electrode 3 with respect to the heat transfer portion 42 and the outer layer 43. In other words, the center C1 of the core 41 is deflected towards the center electrode 3 by a distance D1 with respect to the center C2 of the heat transfer portion 42 and the center C3 of the outer layer 43. In the entire bend portion 4B, the core 41 is deflected towards the center electrode 3. That is, in the cross-sectional view of the ground electrode 4*f*, the cross-sectional areas of the heat transfer portion 42 and the outer layer 43 on the side opposed to the center electrode 3 are larger than those on the center electrode 3 side. Other composition of the sixth embodiment is the same as that of the fourth embodiment.

Also in the spark plug 600, the breakage of the ground electrode 4*f* can be prevented by the core 41. Moreover, as compared to the spark plug 400 of the fourth embodiment in which each center of the heat transfer portion 42 and the outer layer 43 coincide with the center C1 of the core 41, the spark plug 600 can function as a bimetal formed by the outer layer 43, the heat transfer portion 42 and the core 41 each of which has different thermal expansion. Therefore, in the spark plug 600, a lift-up tendency of the ground electrode 4*f* under high temperature conditions is likely to be weakened. Other effects are the same as that of the fourth embodiment.

The present invention has been described in accordance with the above embodiments 1 to 6. The present invention is not limited to the above described embodiment, but may be modified within a range within the scope of the invention and in accordance with the intended object and application.

For example, the cross-sectional shape of the core 41 may not be limited to a rectangular shape, but may be a circular, an ellipse, a triangular or a polygonal shape.

Test 1

Figure 10:
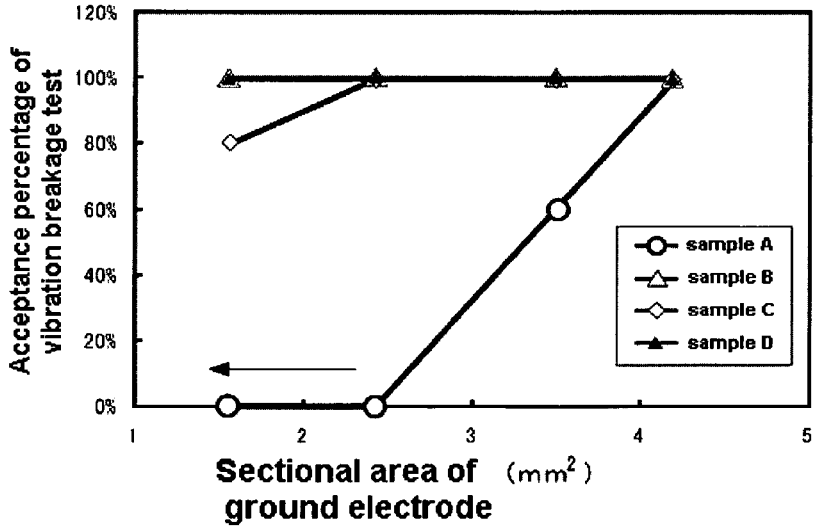
FIG. 10 is a graph showing a relationship between a cross-sectional area of a ground electrode and acceptance percentage of a vibration breakage test according to Test 1.

In order to define a cross-sectional area S of the ground electrode 4, a vibration breakage test was conducted. For the test, test samples A to D having the ground electrode 4 were prepared. In this test, the ground electrode 4 was heated with a burner at 1000 degrees C. and was subject to an impact resistance test based on JIS B8031-1995. Then, the bend portion 4B was observed as to whether or not any breakage occurred therein. An acceptance percentage (%) in n=5 was calculated. In addition, the temperature was measured with a radiation thermometer. FIG. 10 shows a relationship between the cross-sectional area S of the ground electrode 4 and the acceptance percentage of the vibration breakage test.

Test sample A: the ground electrode 4 made of Inconel 601.

Test sample B: the ground electrode 4 made of Inconel 601 and Hastelloy C (equivalent to the ground electrode 4*a* of the first embodiment).

Test sample C: the ground electrode 4 made of Inconel 601, Hastelloy C and copper (equivalent to the ground electrode 4*e* of the fifth embodiment).

Test sample D: the ground electrode 4 made of Inconel 601, Hastelloy C and copper (equivalent to the ground electrode 4*d* of the fourth embodiment).

As shown in FIG. 10, the test samples A of the ground electrode had the cross-sectional area S of 4.2 $mm^2$ or more, and the acceptance percentage was 100%. However, when the test sample A had the cross-sectional area S of less than 4.2 $mm^2$, the acceptance percentage dropped. When the cross-sectional area S was 2.42 $mm^2$ or less, the acceptance percentage was 0%. On the other hand, in the ground electrodes 4*a*, 4*d*, 4*e* constituted by the test samples B to D, respectively, each ground electrode 4*a*, 4*d*, 4*e* having the cross-sectional area S of 2.42 $mm^2$ showed the acceptance percentage of 100%. Furthermore, the ground electrode 4*a*, 4*d* constituted by the test samples B, D and having the cross-sectional area S of 1.4 $mm^2$ showed the acceptance percentage of 100%. In addition, in the ground electrode 4*e* constituted by the test sample C, the acceptance percentage dropped when the cross-sectional area S of the ground electrode 4*e* was less than 2.5 $mm^2$. When the cross-sectional area S of the ground electrode 4*e* was 1.4 $mm^2$, the acceptance percentage was 80%. Because the core 41 made of a metal whose hardness is higher than that of the outer layer 43 is formed in the outer layer 43, it is apparent from this test that reinforcing effect of the ground electrode 4 is improved.

When the cross-sectional area S of the ground electrode 4 is made 2.5 $mm^2$ or less, the spark plugs 100-600 have to be so thin that the ground electrode 4 cannot be enlarged or changed in its shape in order to avoid breakage. In such spark plugs 100-600, the reinforcing effect of the ground electrode 4 can be further improved by forming the core 41 in the outer layer 43.

Test 2

The test samples A-D of the ground electrode 4 were subject to a thermal conduction test. In the test, the entire ground electrode 4 was heated with the burner at 1050 degrees C., which is the upper limit of the anti-oxidation property of Inconel 601. The average temperature of each ground electrode 4 in n=5 was measured. The test was conducted in the condition where the spark plug having one of the test samples A to D of the ground electrode 4 was mounted on a stainless block, which was an imitation of an engine head. Further, inside of the block, a water channel for the cooling water was provided so as to simulate an actual use of the spark plug. In addition, the temperature was measured with a radiation thermometer.

In this test, the test sample A of the ground electrode 4 exhibited the average temperature of 1050 degrees C. and had no thermal conduction property. The test sample B of the ground electrode 4*a* exhibited the average temperature of 1031 degrees C. and had a slight thermal conduction property compared to the test sample A. The test sample C of the ground electrode 4*e* exhibited the average temperature of 874 degrees C. and had excellent thermal conduction property compared to the test samples A, B. In the test sample D of the ground electrode 4*d*, the average temperature was 959 degrees C. The thermal conduction property of the ground electrode 4*d* was not as good as that of the test sample c of the ground electrode 4*e*, however, it was better than that of the test sample A, B of the ground electrode 4, 4*a*. From this test, it is confirmed that the thermal conduction property of the ground electrode 4 having the heat transfer portion 43 in the outer layer 43 is improved.

Test 3

A test was conducted in order to define a ratio of a cross-sectional area A of the core 41 to the cross-sectional area S of the ground electrode 4 when the ground electrode 4 was viewed in the cross-section perpendicular to the extending direction of the ground electrode 4. The conditions of the vibration breakage test were similar to the test 1, and the acceptance percentage (%) in n=5 was calculated. The core 41 was made of Hastelloy C and the outer layer 43 was made of Inconel 601. The relationship between A/S and the acceptance percentage of the vibration breakage test is shown in FIG. 11.

Figure 11:
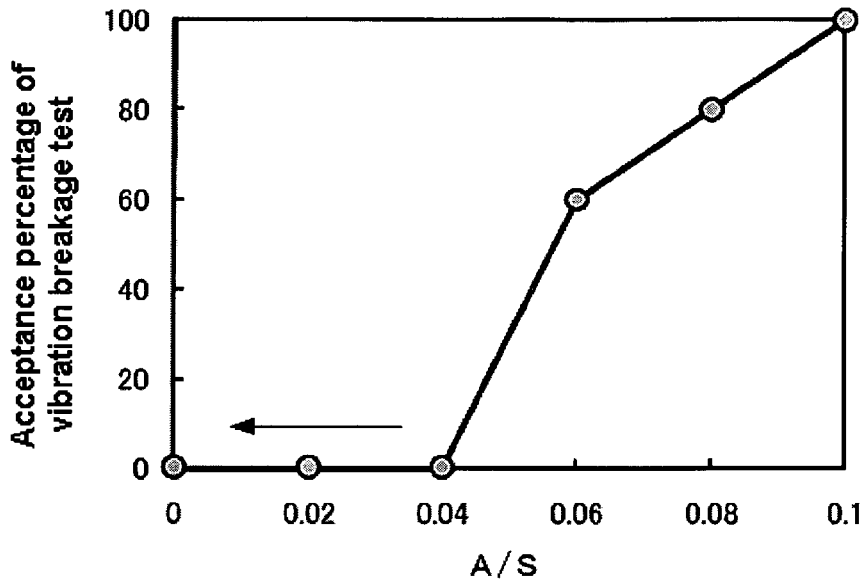
FIG. 11 is a graph showing a relationship between A/S and the acceptance percentage of the vibration breakage test according to Test 3.

As shown in FIG. 11, when the A/S was 0.04 or less, the acceptance percentage was 0%. This result shows that no suppression effect of breakage of the ground electrode 4 is exhibited when the core 41 is too thin. On the other hand, when the A/S was over 0.04, the acceptance percentage increased. When the core 41 had a thickness where the A/S exceeds 0.04, the breakage of the ground electrode 4 was properly suppressed. Further, when the A/S was 0.1 or more, the acceptance percentage was 100%. From this test, it is apparent that the spark plug 100 having the suppression effect of breakage can be stably mass-produced when the A/S is 0.1 or more.

Test 4

A test was conducted in order to define the ratio of a cross-sectional area B of the heat transfer portion 42 to the cross-sectional area S of the ground electrode 4 when the ground electrode 4 was viewed in the cross-section perpendicular to the extending direction of the ground electrode 4. The test conditions were the same as that of the test 2, and the temperature (degree C.) of the ground electrode 4 in n=5 was measured. The relationship between the B/S and the temperature of the ground electrode is shown in FIG. 12.

Figure 12:
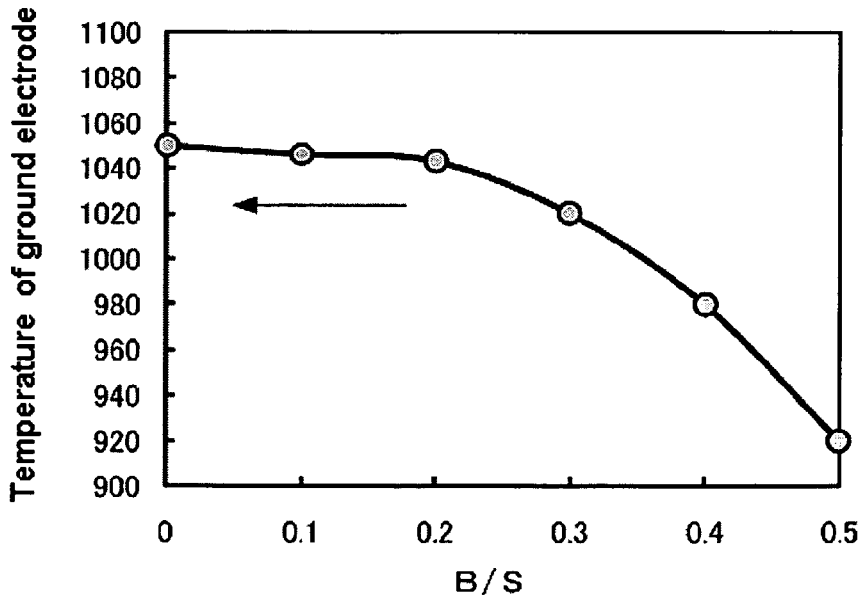
FIG. 12 is a graph showing a relationship between B/S and the temperature of the ground electrode according to Test 4.

As shown in FIG. 12, there was no variation in temperature when the B/S was less than 0.2. This means that thermal conduction of the heat transfer portion 42 was less effective because the heat transfer portion 42 was thin. On the other hand, when the heat transfer portion 42 was made thicker so that the B/S was 0.2 or more, the variation in temperature was wide. From this test, it is apparent that thermal conduction of the heat transfer portion 42 becomes effective as the heat transfer portion 42 is made thicker.

DESCRIPTION OF REFERENCE NUMERALS

1: metal shell
4A: base end portion
4B: bend portion
3: center electrode
4, 4*a*, 4*b*, 4*c*, 4*d*, 4*e*, 4*f*: ground electrode
g: spark discharge gap
4C: front end portion
41: core
43: outer layer
100, 200, 300, 400, 500, 600: spark plug
42: heat transfer portion Having described the invention, the following is claimed:

1. A spark plug, comprising:

a ground electrode having a base end portion fixed to a metal shell, a bend portion integrally formed with the base end portion and being bent, and a front end portion integrally formed with the bend portion and forming a spark discharge gap with a center electrode, wherein the ground electrode is comprised of: a core extending from the base end portion towards the front end portion through the bend portion; and an outer layer disposed outside of the core and extending from the base end portion up to the front end portion through the bend portion, wherein the core is made of a first metal, and the outer layer is made of a second metal, wherein hardness of the first metal is higher than that of the second metal, and wherein when the ground electrode is viewed in a cross-section perpendicular to the extending direction of the ground electrode a center of gravity of the core is deflected towards the center electrode such that the center of gravity of the core is positioned closer to the center electrode than a center of gravity of the outer layer, at least in a middle section of the bend portion.

2. The spark plug according to claim 1, wherein the ground electrode is comprised of a heat transfer portion formed in the outer layer and extending from the base end portion towards the front end portion through the bend portion, and wherein the heat transfer portion is made of a third metal having better thermal conductivity than those of the first metal and the second metal.

3. The spark plug according to claim 2, wherein the heat transfer portion is disposed outside of the core.

4. The spark plug according to claim 2, wherein the core is disposed outside of the heat transfer portion.

5. The spark plug according to claim 1, wherein the second metal has better anti-oxidation properties than that of the first metal in a high-temperature region of 1000 degrees C. or more.

6. The spark plug according to claim 1, wherein the second metal has better anti-spark erosion properties than that of the first metal.

* * * * *